United States Patent [19]

Yoon

[11] 4,418,653

[45] Dec. 6, 1983

[54] ALCOHOL FUEL DUAL-CATALYST TREATMENT APPARATUS AND METHOD

[75] Inventor: Heeyoung Yoon, McMurray, Pa.

[73] Assignee: Conoco Inc., Wilmington, Del.

[21] Appl. No.: 385,747

[22] Filed: Jun. 7, 1982

[51] Int. Cl.[3] ..... F02M 27/02

[52] U.S. Cl. ..... 123/3; 123/576; 123/577

[58] Field of Search ..... 123/1 A, 3, 575, 576, 123/577; 422/222

[56] References Cited

U.S. PATENT DOCUMENTS 4,366,782 1/1983 Jackson et al. ..... 123/3

*Primary Examiner*—William A. Cuchlinski, Jr.

*Attorney, Agent, or Firm*—Dale Lovercheck; William A. Mikesell, Jr.

[57] ABSTRACT

Internal combustion engine fuel treatment including in sequence the steps as follows:

providing a dual catalyst reactor having a dehydration catalyst and dissociation catalyst providing alcohol, vaporing the alcohol to form alcohol vapor, dehydrating a portion of the feed alcohol vapor over the dehydration catalyst to form a first gaseous mixture including ethers, residual alcohol vapor and water, dissociating the residual alcohol vapor over the dissociation catalyst, to form a second gaseous mixture including $H_2$ and CO, conveying the second gaseous mixture to the internal combustion engine, whereby the engine is operated on the second gaseous mixture.

5 Claims, 1 Drawing Figure

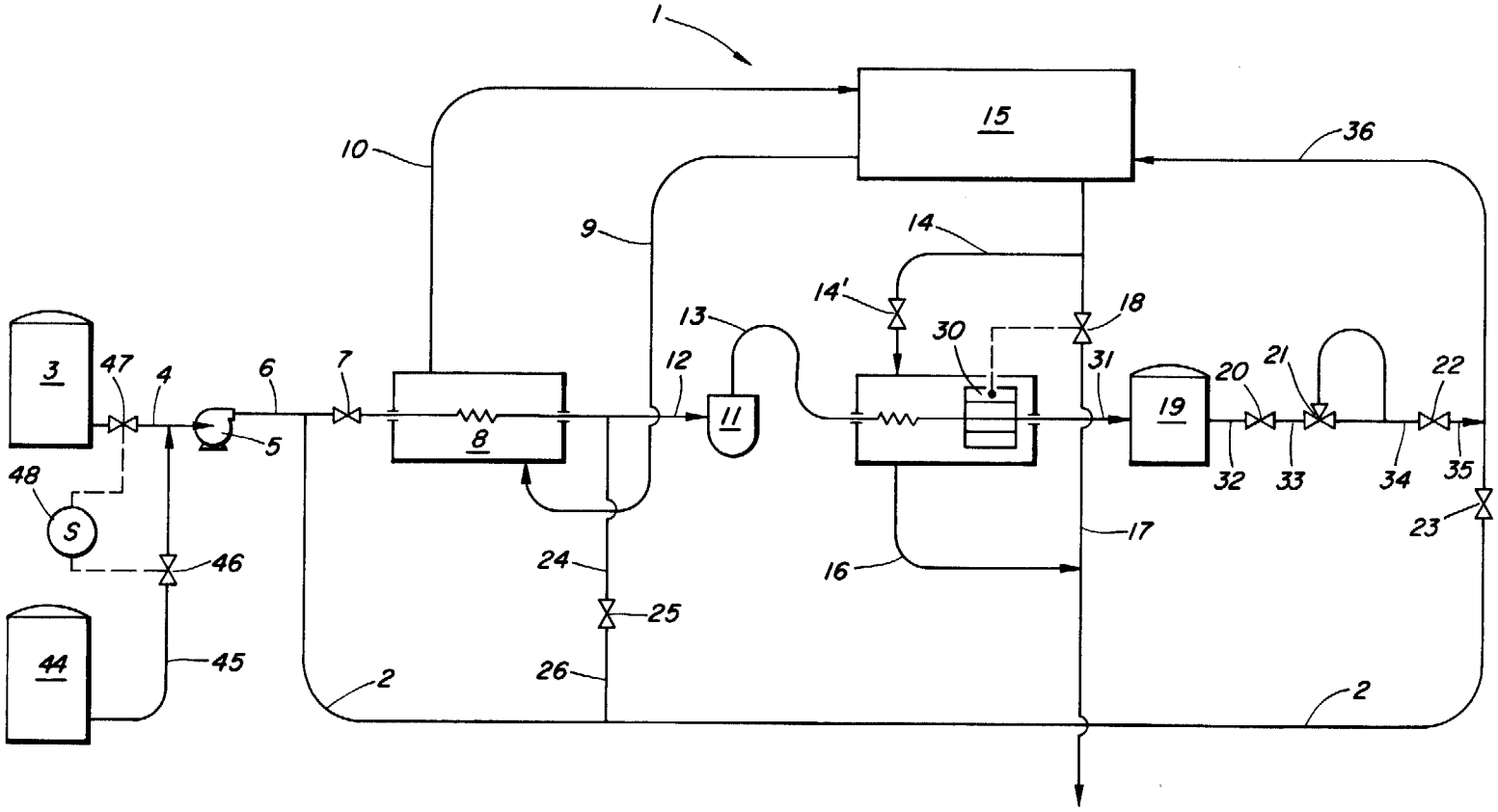
1
2
3
4
5
6
7
8
9
10
11
12
13
14
14'
15
16
17
18
19
20
21
22
23
24
25
26
30
31
32
33
34
35
36
44
45
46
47
48
S

ALCOHOL FUEL DUAL-CATALYST TREATMENT APPARATUS AND METHOD

BACKGROUND OF THE INVENTION

Kosaka et al, discloses in U.S. Pat. No. 4,088,450 a plurality of catalysts arranged in a desirable order based on the temperature gradient existing in the reaction chamber. The operating temperature of the catalyst and the temperature of the portion of the reaction chamber it is in, are matched so as to avoid catalytic degradation and/or catalytic inactivity.

Hindin et al in U.S. Pat. No. 4,091,086 discloses a catalytic composition particularly useful in the production of hydrogen from methanol, especially by steam reforming, which comprises a mixture of zinc oxide, copper oxide, thorium oxide and aluminum oxide whereby the activity and activity maintenance of the catalytic composition is superior relative to a composition otherwise substantially the same but lacking thoria.

Henkel et al in U.S. Pat. No. 3,086,877 discloses a fuel gas obtained in a reformed gas generator through the catalytic reaction of hydrocarbons and a gas containing oxygen and provided to an internal combustion engine has its heat content along with that of the exhaust gas of the engine used to convert methanol endothermically into a gas mixture containing carbon monoxide and hydrogen with the gas mixture so formed fed to one or both the reformed gas generator and, along with the fuel gas, the internal combustion engine.

Peterson et al in U.S. Pat. No. 4,282,835 provides for synthesizing CO and $H_2$ fuel from CO and water in a second synthesizer. The methanol is confined in a fuel tank as a liquid. The water is confined in a water tank. A fuel pump and a water pump pump fuel and water to a mixing valve. A heat exchanger heats the fuel and water to a gas which passed through Ni or $Al_2O_3$ catalyst at 500° C. where the $CH_3OH$ disassociates to CO and $H_2$. The gas passes to a second synthesizer containing Fe or $Al_2O_3$ above 500° C. where $H_2O$ and CO form $H_2$ and $CO_2$ the gas is mixed with air and passed to an engine.

Chen et al in U.S. Pat. No. 4,045,522 provides a preengine converter. The catalyst in the first reactor may be copper zinc chromite. Col. 2, lines 28–35. A second catalyst is a hydrocarbon cracking catalyst such as zeolite.

Kikuchi et al in J. Japan Petrol. Inst., 23, (5), 328–333 (1980) discloses exothermic partial combustion during start-up of a methanol fueled engine. At Table I on page 329 he lists copper oxide zinc oxide catalyst as well as copper nickel catalyst for conversion of methanol on various supported copper catalysts. At page 332 Kikuchi discusses methanol conversion to give a formaldehyde type intermediate which decomposes to hydrogen and carbon monoxide as shown in the first two equations listed therein.

SUMMARY OF THE INVENTION

A method of operating an internal combustion engine comprising in sequence the steps as follows:

providing a dual catalyst reactor having a dehydration catalyst and dissociation catalyst providing alcohol, vaporing said alcohol to form alcohol vapor, dehydrating a portion of said feed alcohol vapor over said dehydration catalyst to form a first gaseous mixture comprising ethers, residual alcohol vapor and water, dissociating said residual alcohol vapor over said dissociation catalyst, to form a second gaseous mixture comprising $H_2$ and $CO_2$, conveying said second gaseous mixture to said internal combustion engine, whereby said engine is operated on said second gaseous mixture.

BRIEF DISCUSSION OF THE DRAWING

The FIGURE is a schematic representation of a method and apparatus in accordance with the present invention.

DETAILED DISCUSSION OF THE INVENTION

The invention relates to a fuel treatment and distribution apparatus and method as shown in the drawing.

The present invention provides an improved alcohol fuel treatment method and apparatus. The method and apparatus of the present invention provide for the dissociation of alcohol to hydrogen and the dehydration of alcohol to form dimethyl ether or higher ethers. Dimethyl ether, for example, is a gaseous fuel at room temperatures with a minus 23° C. boiling point. During operation the alcohol is fed to the engine either through an operational dissociation reactor which is larger and provided with a catalyst for the formation of hydrogen and carbon monoxide or alternatively the methanol is fed directly to the engine. Preferably the combined dissociation and dehydration catalyst for alcohol is Cu/Ni. The combined dissociation and dehydration catalyst is followed by a dissociation catalyst, preferably Cu/Zn is used.

As shown in the drawing, a fuel system is generally shown at 1. The fuel system 1 has a dual-catalyst containing reactor 30 and a by-pass conduit 2. Liquid alcohol is stored in the liquid alcohol storage tank 3. From liquid alcohol storage tank 3 the liquid alcohol is conveyed in liquid alcohol conduit 4 by pump 5 to vaporizer feed line 6 and by-pass conduit 2. Liquid alcohol passes from vaporizer feedline 6 through solenoid valve 7 and into the vaporizer 8. The vaporizer 8 is heated by engine coolant which enters vaporizer 8 through vaporizer heat transfer feedline 9. From the vaporizer the engine coolant returns to the engine through vaporizer heat transfer fluid output line 10. The vaporized alcohol is conveyed from the vaporizer 8 to the liquid trap 11 by line 12 and from the liquid trap 11 through line 13 to the dual-catalyst containing reactor 30. The dual-catalyst containing reactor 30 operates at about 600° F. The vaporized alcohol is dissociated into hydrogen and carbon monoxide in the dual-catalyst containing reactor 30. In reactor 30 the Cu/Zn and Cu/Ni catalysts may be used with or without promoters such as chromium.

The catalyst containing reactor 30 and the superheater shown in the drawing are heated by exhaust from the internal combustion engine 15. Exhaust from the internal combustion engine 15 is conveyed by conduit 14 having solenoid valve 14' to the catalyst containing reactor 30. The engine exhaust leaves the catalyst containing reactor 30 through the conduit 16. This cooled engine exhaust may be recycled to the engine or exhausted to the atmosphere or partially recycled and partly exhausted to the atmosphere. The superheater shown in the drawing after line 13 and before reactor 30 heats the fuel which is heated to about 200° F. in a vaporizer 8 and superheated to about 600° F. in the superheater.

An exhaust flow valve 18 is provided with temperature control, to control the temperature of the catalyst containing reactor 30. Engine exhaust from the engine 15 may be by-passed around the catalyst containing reactor 30 through the exhaust flow valve 18 and into the exhaust flow conduit 17. By controlling the amount of exhaust used to heat the catalyst containing reactor 30 the temperature of the catalyst containing reactor may be regulated. The exhaust flow valve 18 is connected to a temperature sensor on the reactor 30.

Shifted dissociated alcohol from the dual-catalyst containing reactor 30 passes through conduit 31 into storage tank 19. Storage tank 19 provides gas for use during startup and surge conditions such as acceleration. From the storage tank 19 gas travels through conduit 32 to the solenoid valve 20. From the solenoid valve 20 gas travels through line 33 to the pressure control valve 21. From the pressure control valve 21 the dissociated alcohol travels through line 34 to the gas control mechanism 22. From the gas control mechanism 22, the gas travels through line 35 to fuel feed conduit 36 into engine 15. The gas control mechanism 22 and the fuel flow mechanism 23 may be that of an automobile fuel injection system or an automobile carburetor.

Undissociated alcohol from by-pass conduit 2 also passes into fuel feed conduit 36. By-pass conduit 2 is provided with fuel flow mechanism 23. Fuel flow mechanism 23 controls the amount of undissociated alcohol to be fed into the internal combustion engine 15 via fuel feed conduit 36.

The preferred alcohol for use in the fuel system is methanol. Among the advantages of the by-pass system is that more fuel material may be passed into the internal combustion engine 15 during periods of peak operation, such as in the case where quantities of fuel in excess of those of normal operation are needed for example during startup and acceleration.

The line 24 connects evaporator 8 to valve 25. Line 26 connects valve 25 to line 2. Valve 25 and the valve 50 in line 2 control the proportion of liquid and vapor feed through line 2. Thus, evaporated methanol may be fed to line 2 to provide a mixed feed of vaporized methanol and liquid methanol to engine 15 via line 36.

Because of the capacity of the acceleration loop, the dual-catalyst reactor need only be large enough to handle normal operation conditions. Periods of peak operation can be handled by the capacity of the acceleration loop.

In another embodiment of the invention, the tank 3 may contain gasoline or alternatively, the tank 3 may contain an alcohol fuel and an additional tank contains an alternative fuel such as gasoline, this additional tank is in fluid flow communication with line 2 for example by being connected to line 4. When operating on gasoline the valves 7, 14' and 20 are closed and the gasoline is fed through the line 2 through the fuel flow mechanism 23 to the engine 15.

When the engine is turned off the valves 7, 14', 20 and 38 are closed. In closing these valves dissociated gas is trapped in the storage tank 19. This stored hydrogen optionally is forced from tank 19 through open valve 20 into engine 15.

In an embodiment of the invention using more than one fuel tank, a selector switch 48 which provides for the selection of which fuel is to be used is provided by control of the feed valves from the storage tank for each fuel. In this embodiment of the invention, the valve 47 is in line 4 between the pump 5 and the storage tank 3. Additionally, the additional storage tank 44 is connected to the line 4 by line 45. The valve 46 is in the line 45 connecting the additional storage tank 44 to line 4. The valve 47 is in the line 4 between the storage tank 3 and the line 45 connecting line 4 with the additional storage tank 44. The selector switch 48 controls the valves 46 and 47 to proportion each fuel used or to select which fuel is used alone. Preferably the tank 44 contains gasoline.

Where methanol is the fuel in storage tank 3, the reactions:

$$2CH_3OH \rightarrow CH_3-O-CH_3 + H_2O \quad \text{(I)}$$

and $$CH_3OH \rightarrow CO + 2H_2 \quad \text{(II)}$$

take place in the first portion of the dual-catalyst reactor and the reaction:

$$CO + H_2O \rightarrow CO_2 + H_2 \quad \text{(III)}$$

as well as reaction II take place in the second portion of the dual-catalyst reactor 30. In the engine 15, $CO_2$ and $H_2$ from line 36 are mixed with $O_2$ for example in a carburetor with an air intake opening, and combusted according to the reaction $$2H_2 + O_2 \rightarrow 2H_2O \quad \text{(IV)}$$

The reaction (I) is somewhat exothermic the change in enthalpy at 298° K. being $-2.35$ $K_{cal}$ per g-mole of gaseous methanol. This heat being recovered from the exhaust.

While the invention has been described above with respect to certain of its preferred embodiments, it is respectfully pointed out that many variations and modifications are possible within the scope of the present invention and it is anticipated that many such variations and modifications may appear obvious or desirable to those skilled in the art based upon a review of the foregoing description of preferred embodiments.

What is claimed is:

1. A fuel treatment and distribution apparatus in combination comprising:

an internal combustion engine an alcohol fuel storage tank, a vaporizer means, a dual catalyst containing reactor means, said catalyst containing reactor comprising a dehydrated catalyst means and a dissociation catalyst means, said dehydration catalyst being active in the catalysis of methanol to form dimethyl ether and water, said dissociation catalyst being active in the catalysis of methanol to form carbon monoxide and hydrogen, said alcohol storage tank being in fluid flow communication with said vaporizer means, said vaporizer being in fluid flow communication with said dual catalyst containing reactor means, so that alcohol vapor from said vaporizer means first passes through said dehydration catalyst means and then passes through said dissociation catalyst means, said catalyst containing reactor means being in fluid flow communication with said internal combustion engine, whereby at least a portion of the alcohol from said alcohol storage tank is dehydrated to form water and an ether in said dehydration catalyst means and at least a portion of said alcohol is dissociated to $H_2$ and CO in said dissociation catalyst means and at least a portion of said water and said CO reacts to form $CO_2$ and $H_2$ prior to being passed to said engine.

2. The apparatus of claim 1 further comprising providing a by-pass conduct means in fluid flow communication with said alcohol storage means and said engine and circumventing said reactor means.

3. A method of operating an internal combustion engine comprising in sequence the steps as follows:

(a) providing a dual catalyst reactor having a dehydration catalyst and dissociation catalyst (b) providing alcohol, (c) vaporing said alcohol to form alcohol vapor, (d) dehydrating a portion of said feed alcohol vapor over said dehydration catalyst to form a first gaseous mixture comprising ethers, hydrogen, residual alcohol vapor and water, (e) dissociating at least a portion of said residual alcohol vapor over said dissociation catalyst, to form a second gaseous mixture comprising $H_2$, (f) conveying said second gaseous mixture to said internal combustion engine, whereby said engine is operated by combustion of said second gaseous mixture with air.

4. The method of claim 3 wherein said alcohol is methanol, said dehydration catalyst comprises Cu/Ni and said dissociation catalyst comprises Cu/Zn.

5. A method of operating an internal combustion engine comprising in sequence the steps as follows:

(a) providing a dual catalyst reactor means having a dehydration catalyst and dissociation catalyst said dehydration catalyst being active in the catalysis of methanol to form dimethyl ether and water, said dissociation catalyst being active in the catalysis of methanol to form carbon monoxide and hydrogen, (b) providing methanol, (c) vaporing said methanol to form methanol vapor, (d) dehydrating a portion of said feed methanol vapor over said dehydration catalyst in a first portion of said reactor means to form dimethyl ether, water and a portion of the hydrogen of a first portion gaseous mixture and dissociating at least a portion of said methanol vapor over said dissociation catalyst in said first portion of said reactor means, to form carbon monoxide and a portion of the hydrogen of said first portion gaseous mixture said first portion gaseous mixture comprising hydrogen, water, carbon monoxide, dimethyl ether and residual methanol, (e) dissociating at least a portion of said residual methanol in a second portion of said reactor means to form carbon monoxide and a portion of the hydrogen of a second portion gaseous mixture, (f) forming a portion of the hydrogen of said second portion gaseous mixture by reaction of said water formed in said first reactor portion with carbon monoxide, to form said second portion gaseous mixture comprising hydrogen, said second portion gaseous mixture being formed in the presence of said first portion gaseous mixture whereby a combustion feed gaseous mixture comprising hydrogen and dimethyl ether is formed, (g) conveying said combustion feed gaseous mixture to said internal combustion engine, whereby said engine is operated by combustion of said combustion feed gaseous mixture with air.

* * * * *